US007175056B2

(12) United States Patent
Buti

(10) Patent No.: US 7,175,056 B2
(45) Date of Patent: Feb. 13, 2007

(54) SIMPLIFIED SPRAYER DEVICE

(75) Inventor: Sario Buti, Bassano del Grappa (IT)

(73) Assignee: Spray Plast S.p.A. (IT)

( * ) Notice: Subject to any disclaimer, the term of this patent is extended or adjusted under 35 U.S.C. 154(b) by 0 days.

(21) Appl. No.: 10/542,761

(22) PCT Filed: Jan. 14, 2004

(86) PCT No.: PCT/EP2004/000184

§ 371 (c)(1),
(2), (4) Date: Jul. 20, 2005

(87) PCT Pub. No.: WO2004/065021

PCT Pub. Date: Aug. 5, 2004

(65) Prior Publication Data

US 2006/0054642 A1 Mar. 16, 2006

(30) Foreign Application Priority Data

Jan. 21, 2003 (IT) ..... MI2003A0080

(51) Int. Cl.
*B67D 5/40* (2006.01)

(52) U.S. Cl. ..... 222/383.1; 222/340

(58) Field of Classification Search ..... 222/383.1, 222/380, 340; 239/333
See application file for complete search history.

(56) References Cited

U.S. PATENT DOCUMENTS 5,156,304 A * 10/1992 Battegazzore ..... 222/341
5,228,602 A * 7/1993 Maas et al. ..... 222/340
5,566,885 A * 10/1996 Foster et al. ..... 239/333
5,628,434 A * 5/1997 Foster et al. ..... 222/383.1
5,645,221 A * 7/1997 Foster ..... 239/333
5,706,984 A * 1/1998 Tada et al. ..... 222/182
5,711,461 A * 1/1998 Foster et al. ..... 222/383.1
5,906,301 A * 5/1999 Foster ..... 222/383.1
6,267,271 B1 * 7/2001 Tsuchida et al. ..... 222/383.1
6,364,172 B1 * 4/2002 Maas et al. ..... 222/383.1
6,641,003 B1 * 11/2003 Foster et al. ..... 222/383.1
6,679,874 B2 * 1/2004 Miser ..... 606/1
6,869,027 B2 * 3/2005 Foster et al. ..... 239/304
2004/0217134 A1 * 11/2004 Foster et al. ..... 222/383.1

FOREIGN PATENT DOCUMENTS

EP 0 850 695 A2 7/1998
JP 09 253540 9/1997
JP 09 314001 12/1997
JP 10 128184 5/1998

* cited by examiner

*Primary Examiner*—Kevin Shaver
*Assistant Examiner*—Stephanie E. Tyler
(74) *Attorney, Agent, or Firm*—Rothwell, Figg, Ernst & Manbeck

(57) ABSTRACT

A sprayer device (10) with a trigger pump (29) includes a substantially L-shaped body (14) that can be applied to a container for liquids and is provided with a sprayer nozzle (15). A chamber (20) wherein a plunger (33) of the pump slides, an input duct (37) which puts the container into communication with the chamber and an output duct (38) which puts the chamber into communication with the nozzle are formed inside the body. A suction and delivery valve (100) which allows the suction of the liquid from the inside of the chamber and the delivery of the liquid from the chamber to the sprayer nozzle is installed in the chamber of the sprayer body. The stem (32) of the plunger of the pump is operated by a trigger (29) biased by a spring (60).

8 Claims, 5 Drawing Sheets

SIMPLIFIED SPRAYER DEVICE

CROSS-REFERENCE TO RELATED APPLICATION

This application is a National Phase of International Application Serial No. PCT/EP04/000184, filed Jan. 14, 2004.

BACKGROUND OF THE INVENTION

1. Field of the Invention

The present invention refers to a sprayer device, such as a pump sprayer operated manually by means of a trigger lever.

2. Description of the Background Art

Particular reference will be made hereinunder to sprayers for liquids, it being understood that said sprayers can also be used to spray any type of fluid, such as foams and the like, for example.

A sprayer of this type generally comprises a main body provided with a base with a threaded cap to be applied to the mouth of a liquid container, a delivery nozzle from which the liquid is sprayed, a spring-biased trigger lever that can be operated manually by the user, and a pump operated by the trigger lever to suck the liquid from the container and to spray it through the sprayer nozzle.

The pump has piston acting in a chamber formed in the sprayer body. The sprayer body further comprises an input duct which puts the inside of the liquid container into communication with the pump chamber and an output duct which puts the pump chamber into communication with the sprayer nozzle.

Accordingly, provided inside the pump chamber is a fluid suction and delivery valve suitable to allow suction of the fluid from the container to the pump chamber and delivery of the fluid from the pump chamber to the sprayer nozzle in a selective, one-way manner.

Sprayers according to the prior art present drawbacks.

Some drawbacks are due to the suction and delivery valve. In fact said type of valve is quite delicate and therefore it is subject to frequent breakage, jamming and obstruction of the suction and delivery channels, with the result of making the sprayer unserviceable.

Other drawbacks are due to the spring which biases the trigger, which is generally disposed inside the body of the piston. In fact said spring is obliged to have a spiral shape and, being in contact with the product, must be made of AISI steel. These characteristics make it excessively costly.

Furthermore, the spring disposed inside the piston body limits the volume of product delivered during spraying.

Other drawbacks are due to the spring which biases the trigger, which is generally disposed inside the body of the piston. In fact said spring is obliged to have a spiral shape and, being in contact with the product, must be made of AISI steel. These characteristics make it excessively costly.

Furthermore, the spring disposed inside the piston body limits the volume of product delivered during spraying.

EP-0.850.695 discloses a dispenser for liquid. In particular, such a dispenser comprises a valve member having a collar portion received and held in a complementary groove which is formed in the dispenser body. Such an arrangement is complex and not reliable.

The object of the present invention is to overcome the drawbacks of the prior art by providing a sprayer device with a trigger-operated pump which is extremely reliable and able to ensure a perfect operation, avoiding problems of failures, and jamming of the valve of the pump.

Another object of the present invention is to provide a sprayer device provided with a spring for the trigger of the pump that is cheap, practical and efficient.

These objects are achieved, according to the invention, with the characteristics listed in appended independent claim 1.

Advantageous embodiments of the invention are apparent from the dependent claims.

The sprayer device with trigger-operated pump according to the invention comprises a substantially L-shaped body that can be applied to a liquid container and is provided with a sprayer nozzle. Formed inside the body there are a chamber wherein a pump plunger slides, an input duct which puts the container into communication with the chamber and an output duct which puts the chamber into communication with the sprayer nozzle.

Disposed in the chamber of the sprayer body there is a suction and delivery valve to generate a first one-way passage between said input duct of the sprayer body and said chamber and a second one-way passage between said chamber and said output duct of the sprayer body.

SUMMARY OF THE INVENTION

The object of the present invention is to overcome the drawbacks of the prior art by providing a sprayer device with a trigger-operated pump which is extremely reliable and able to ensure a perfect operation, avoiding problems of failures, and jamming of the valve of the pump.

Another object of the present invention is to provide a sprayer device provided with a spring for the trigger of the pump that is cheap, practical and efficient.

These objects are achieved, according to the invention, with the characteristics disclosed herein.

Advantageous embodiments of the invention are apparent from the dependent claims.

The sprayer device with trigger-operated pump according to the invention comprises a substantially L-shaped body that can be applied to a liquid container and is provided with a sprayer nozzle.

Formed inside the body there are a chamber wherein a pump plunger slides, an input duct which puts the container into communication with the chamber and an output duct which puts the chamber into communication with the sprayer nozzle.

Disposed in the chamber of the sprayer body there is a suction and delivery valve to generate a first one-way passage between said input duct of the sprayer body and said chamber and a second one-way passage between said chamber and said output duct of the sprayer body.

The peculiarity of the invention is represented by the fact that the suction and delivery valve advantageously comprises a central portion fixed to the sprayer body, an upper portion that acts as a shutter between the chamber and the output duct and a lower portion that acts as a shutter between the input duct and the chamber.

BRIEF DESCRIPTION OF THE DRAWINGS

Further characteristics of the invention will be made clearer by the detailed description that follows, referring to a purely exemplary and therefore non limiting embodiment thereof, illustrated in the appended drawings, in which.

DETAILED DESCRIPTION OF THE INVENTION

Figure 1:
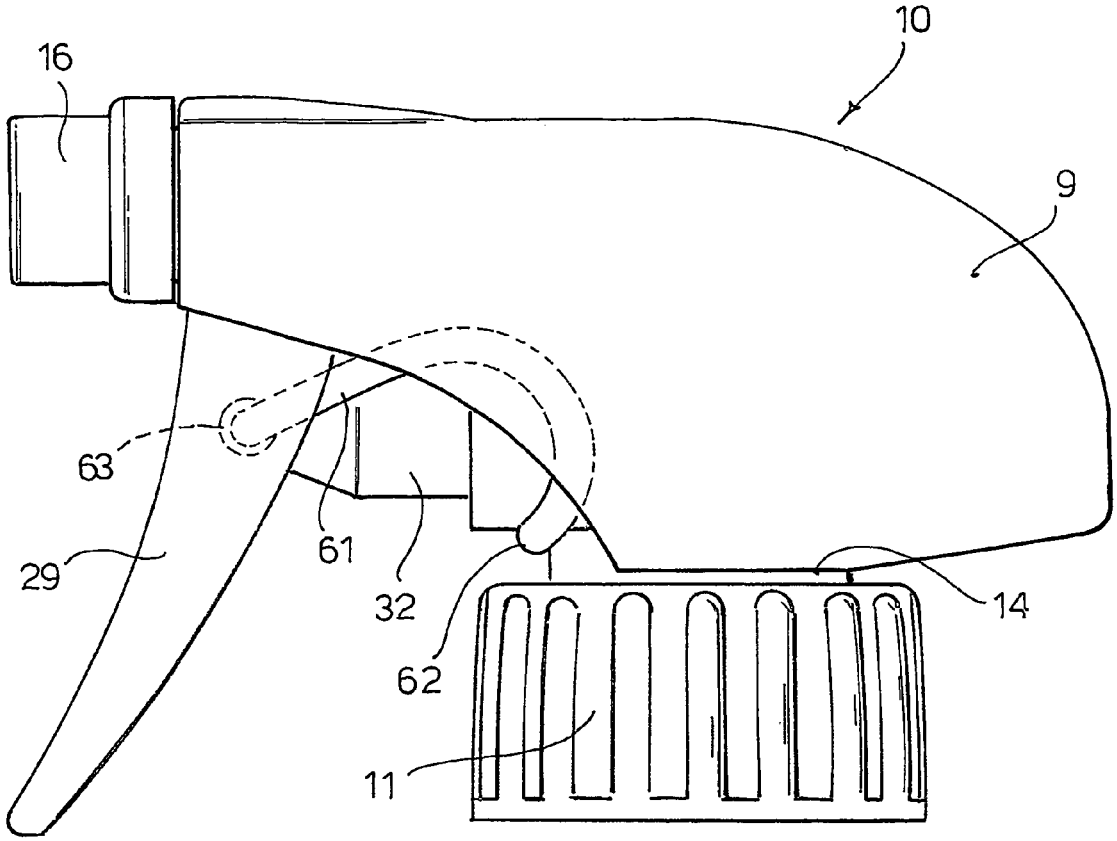
FIG. 1 is a side elevation of a sprayer according to the invention.

A sprayer device according to the invention, denoted as a whole with reference numeral 10, is described with the aid of the figures.

A fixing cap 11—having an inner thread suitable to engage with an outer thread of the mouth of a container (not shown) suitable for containing a liquid such as for example household cleaning liquids—is rotatably mounted at the base of the sprayer 10.

Figure 2:
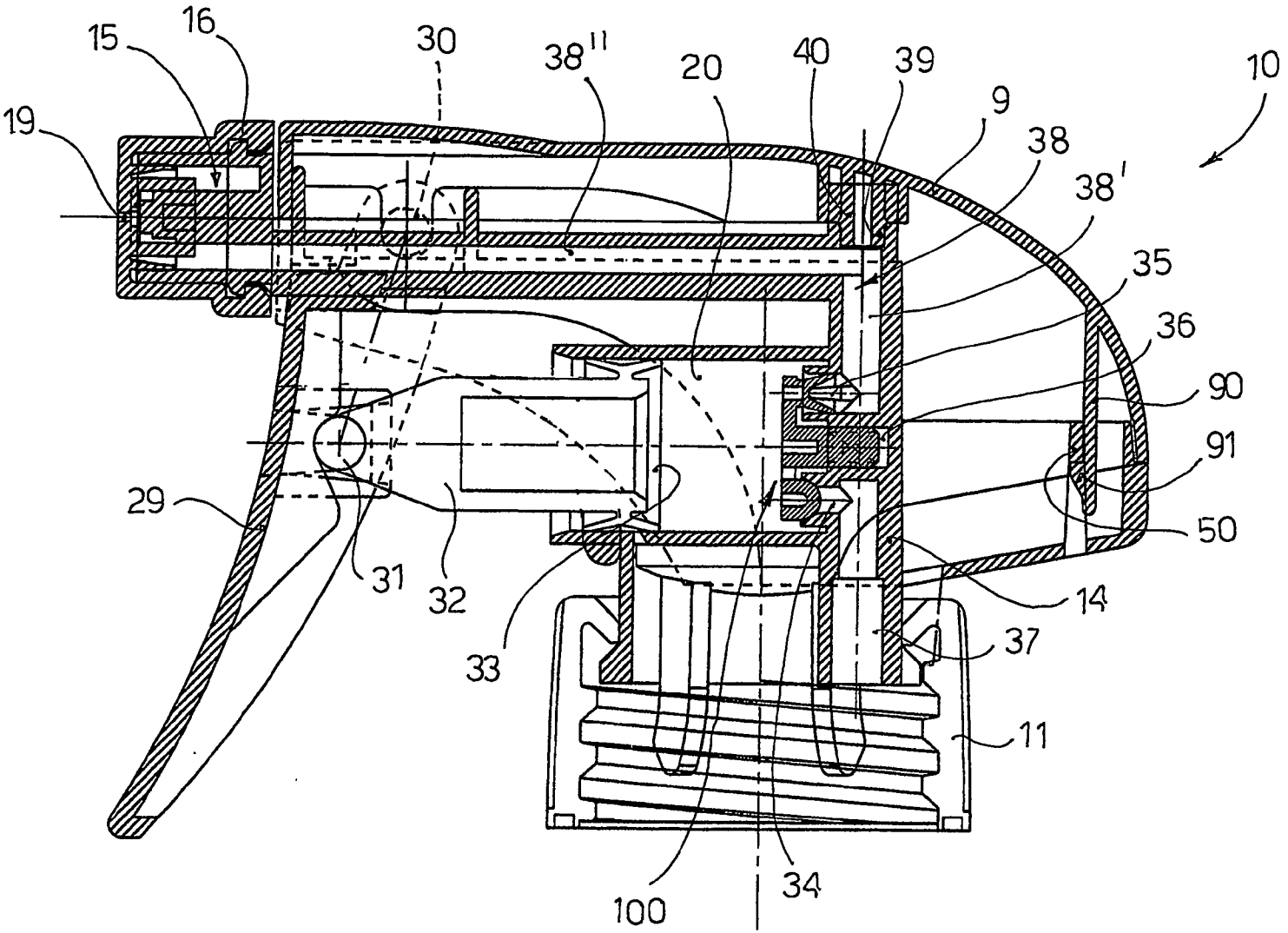
FIG. 2 is an axial sectional view of the sprayer of FIG. 1, in which the trigger spring has been omitted for greater clarity.

The cap 11 is mounted on a cylindrical base body connected to the sprayer body 14, which, as shown in FIG. 2, is substantially L-shaped and ends in a delivery nozzle 15 with an opening from which the liquid is delivered.

Above the front end of the body 14, wherein the sprayer nozzle 15 is positioned, a sprayer cap 16 is rotatably mounted. The sprayer cap 16 has at least one hole 19 for the passage of the liquid to be sprayed. When the sprayer cap 16 is positioned in the spraying position, delivery of liquid to the outside is allowed. On the other hand, when the sprayer cap 16 is positioned in the non-spraying position the liquid is prevented from leaving the sprayer nozzle 15 by the wall of the sprayer cap 16.

The body 14 is covered by a protective shell 9, also substantially L-shaped.

The sprayer 10 comprises a trigger 29 hinged at one end 30 to the body 14 of the sprayer and at an intermediate portion 31 to a stem 32 of a plunger 33.

As shown in FIG. 1, spring means 60 which bias the trigger 29 towards a forward position are interposed between the trigger 29 and the body 14 of the sprayer.

Figure 3:
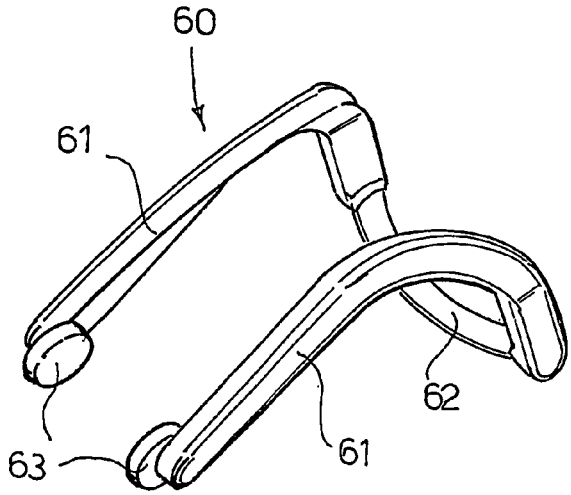
FIG. 3 is a perspective view of the trigger spring of the sprayer of FIG. 1.

As shown better in FIG. 3, the spring means 60 consist of a spring, substantially of the leaf type, which has two elastic arms 61 parallel to each other. The arms 61 are connected, at one end thereof, to a slightly curved cross connecting bar 62. In the free ends of the arms 61 there are provided respective disc-shaped pins 63, able to be hinged to the trigger 29, in the same position 31 in which the stem 32 of the plunger is hinged.

Each arm 61 of the leaf spring has an arched shape, substantially C-shaped in a side view. The radius of curvature of the C is designed so that the connecting bar 62 abuts forwardly against the body 14 of the sprayer, in a position beneath the plunger chamber. In fact, as shown in FIG. 2, the neck of the body 14 and the lower part of the plunger chamber 33 form an abutment corner 65 able to receive the cross connecting bar 62 of the leaf spring 60.

It should be noted that the stem 32 of the plunger passes, during its stroke, between the arms 61 of the spring 60 and does not interfere therewith.

The spring 60 can be made in a single piece by injection moulding. An acetal resin which ensures adequate elasticity and stiffness of the arms 61 is preferably used.

The plunger 33 is mounted to slide horizontally, with a tight seal, inside a chamber 20 defined in the sprayer body 14. The chamber 20 has a rear wall provided with an input hole 34 disposed at the bottom, an output hole 35 disposed at the top and a housing seat 36 disposed in a central position between the input hole 34 and the output hole 35.

The input hole 34 communicates with a substantially vertical input duct 37 formed in the body 14 and open at the bottom to communicate with the inside of the liquid container.

The output hole 35 communicates with an output duct 38, substantially L-shaped, formed in the body 14. The output duct 38 has a first, substantially vertical channel 38' which communicates with the output hole 35 and with a second substantially horizontal channel 38".

The horizontal channel 38" of the L-shaped output duct has an axis substantially parallel to the axis of the chamber 20 and ends in the sprayer nozzle 15. The vertical channel 38' of the L-shaped output duct, on the other hand, is substantially coaxial to the input duct 37. Clearly the input duct 37 and the output duct 38 do not communicate with each other.

Since the body 14 is made in a single piece by injection moulding, the vertical channel 38' of the output duct 38 is made by means of a vertical moulding hole 39 made on the upper portion of the body 14. The moulding hole 39 is tightly sealed by a tang 40 formed in the inner side of the upper cover of the shell 9 covering the body 14.

As can be seen in FIGS. 1 and 2, the shell 9 is made in a single piece and is shaped like a semi-cylindrical cover, substantially U-shaped in cross section. In the rear portion of the cover 9 a rib 90 protruding downwards from the inner surface thereof is provided. The rib 90 ends in a tooth 91 which fixedly engages with a protrusion 50 of the sprayer body.

It should be noted that the cover shell 9 is easily and rapidly mounted on the sprayer body 14 by simply locking the tang 40 of the cover in the hole 39 of the body and the tooth 91 of the rib 90 of the cover in the protrusion 50 of the sprayer body. Thus the tang 40 of the cover 9 not only acts as a sealing element for the hole 39 of the sprayer body, but also as a fixing element for the cover 9 of the sprayer body.

The rear tooth 91 of the cover 9 can be replaced by two lateral teeth which engage the sprayer body laterally.

Figure 6:
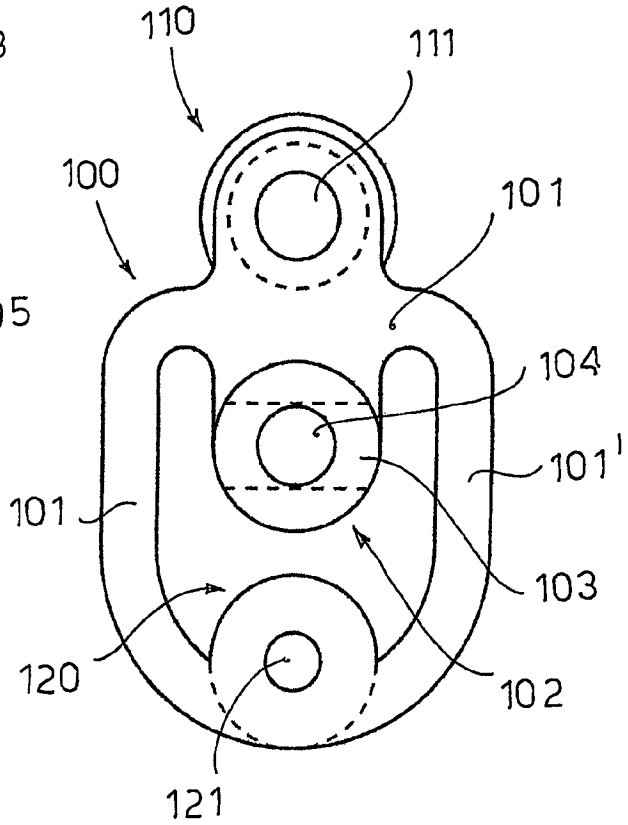
FIG. 6 is a front view of the suction and delivery valve of the sprayer.
Figure 5:
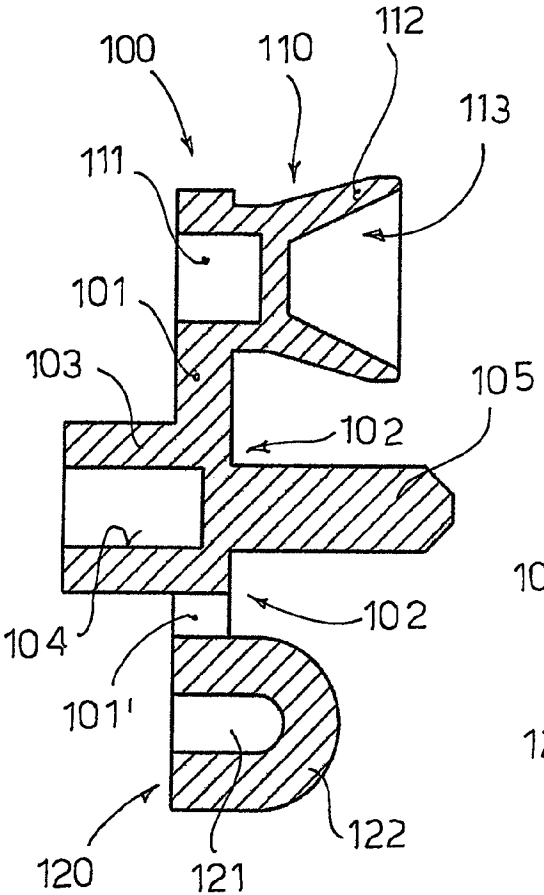
FIG. 5 is an axial sectional view of the suction and delivery valve taken along the plane of section V—V of FIG. 4.
Figure 4:
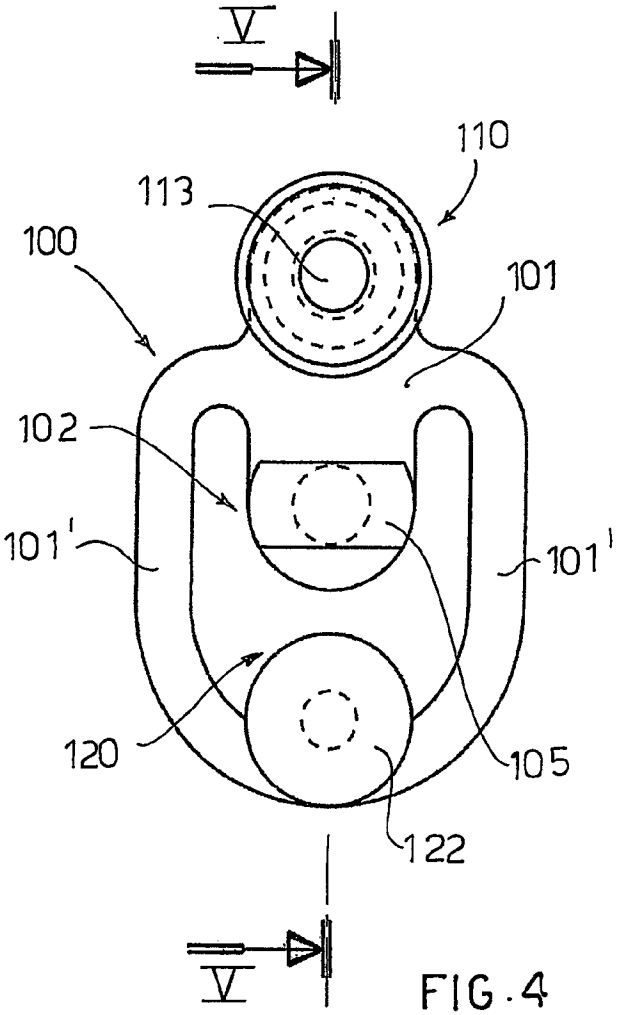
FIG. 4 is an enlarged back view of the suction and delivery valve of the sprayer.

A one-way fluid suction and delivery valve, denoted as a whole with reference numeral 100 and better illustrated in FIGS. 4–6, is installed in the rear wall of the chamber 20. In said figures the valve 100 is shown with a slightly different structure from that of the overall sections of FIGS. 1, 5 and 6, but this is irrelevant for the purposes of operation of the valve of the invention.

The suction and delivery valve 100 is made of sufficiently deformable material and has a substantially elliptical main body 101. The body 101 of the valve has a central portion 102, an upper portion 110 and a lower portion 120, all substantially circular in shape.

The central portion 102 and the upper portion 110 are integral with each other and connected to the lower portion 120 by means of two flexible side bridges 101'.

A cylindrical tang 103 provided with a blind hole 104 protrudes forward from the central portion 102. Again from the central portion 102, a parallelepiped rib 105 able to engage in the central seat 36 formed in the rear wall of the chamber 20 of the plunger protrudes rearward. In this manner the valve 100 is irremovably connected to the sprayer body.

The upper portion 110 of the valve has at the front a blind hole 111. A frustoconical tang 112—with a diameter that increases toward the right with reference to FIG. 5—protrudes rearward from the upper portion 110. The frustoconical tang 112 has on its inside a tapered hole 113, so that the sidewall of the frustoconical tang 112 has a sufficiently small thickness to be deformed radially inward.

The frustoconical tang 112 is of such a size as to be able to be housed tightly in the output hole 35 of the rear wall of the plunger chamber 20. In this manner the frustoconical tang 112 acts as a shutter for the output hole 35.

The lower portion 120 of the valve has at the front a blind hole 121 with a rounded end and at the rear a substantially dome-shaped portion 122, with an upturned C-shape in the section view of FIG. 5.

The dome 122 is of such a size as to engage tightly in the input hole 34 of the rear wall of the plunger chamber 20. In this manner the dome 122 acts as a shutter for the input hole 34.

Figure 7:
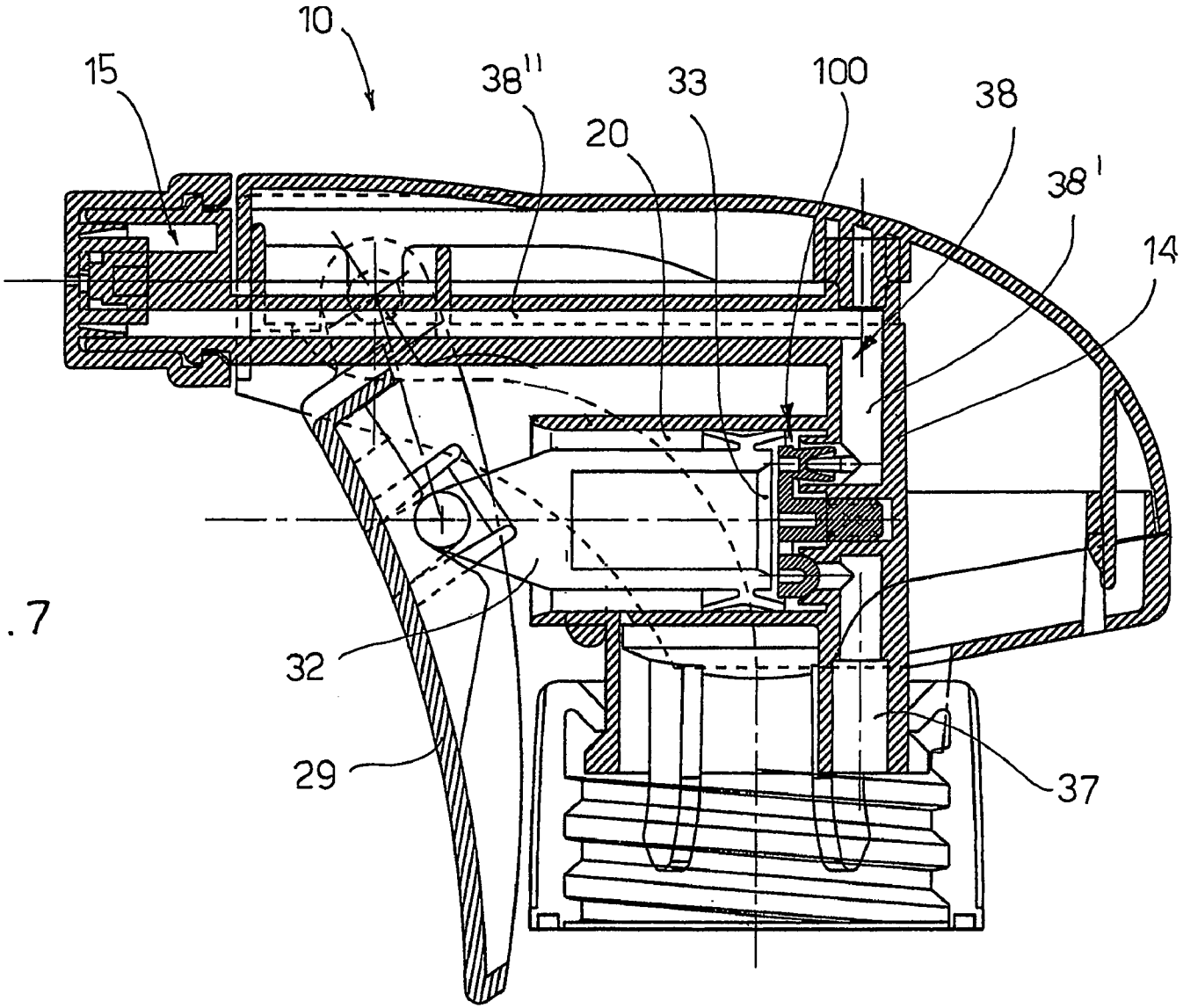
FIG. 7 is a view partially in axial section, like FIG. 2, of the sprayer in the spraying condition.
Figure 8:
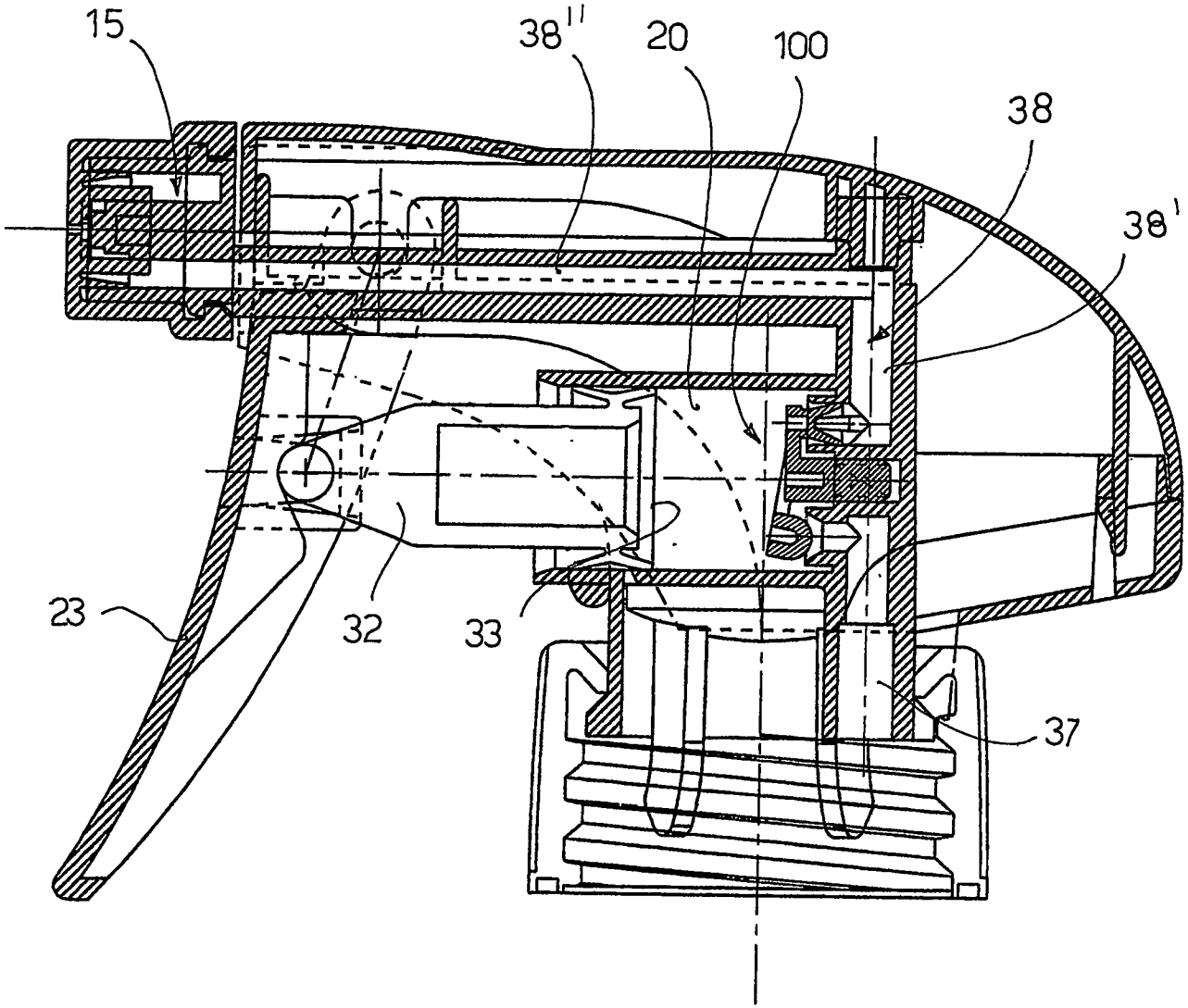
FIG. 8 is a view partially in axial section, like FIG. 2, of the sprayer in the suction condition.

Operation of the sprayer 10 is described with the aid of FIGS. 7 and 8.

In an initial condition, as shown in FIG. 2, the plunger chamber 20 is full of liquid and the plunger 33 is in a position distal to the valve 100.

When the user squeezes the trigger 29 and compresses the spring 60, further bending the arms 61, as shown in FIG. 7, the plunger 33 moves in the chamber 20 towards the valve 100. As a result the liquid contained in the chamber 20 presses against the sidewall of the frustoconical tang 112 of the upper portion of the valve causing an inward radial deformation thereof.

In this manner the sidewall of the frustoconical tang 112 no longer seals the output hole 35 of the rear wall of the chamber 20 and an annular space is created for passage of the liquid. Consequently the liquid passes from the chamber 20, through the output hole 35, into the output duct 38. Thus the liquid, travelling under pressure along the output duct 38 reaches the sprayer nozzle 15 through which it is delivered to the outside.

It should be noted that during said operation, the liquid in the chamber 20 also presses against the hole 121 of the bottom dome-shaped portion 122, which seals the input hole 34 preventing the liquid from leaving the chamber 20 toward the input duct 37.

Subsequently, through the action of the spring means 60, the trigger 29 comes back to the starting position, recalling the plunger 33 into position distal to the valve 100. As shown in FIG. 8, during this movement the plunger 33 creates a vacuum in the chamber 20. As a result there is a sucking of the lower portion 120 of the valve, thus the valve body bends in the side bridges 101' and the dome portion 122 disengages from its housing seat in the input hole 34, putting the chamber 20 into communication with the inside of the container (FIG. 8).

Thus, by virtue of the vacuum in the chamber 20, the liquid contained in the container is sucked from the inside of the container into the chamber 20, through the input duct 37 and the input hole 34, so as to fill the chamber 20 when the plunger reaches the end of its stroke in a position distal to the valve 100.

It should be noted that the use of an external spring 60 provides various advantages compared with internal springs of the prior art. In fact, since the spring 60 is not in contact with the product, there is greater freedom of choice in the materials and in the shape of the spring. Furthermore, an increase in the volume of product delivered during spraying is obtained with respect to sprayers with an internal spring of the prior art with the same chamber bore and piston stroke.

Numerous variations and modifications of detail within the reach of a person skilled in the art can be made to the present invention without thereby departing from the scope of the invention, as set forth in the appended claims.

The invention claimed is:

1. A sprayer device (10) with a trigger-operated pump comprising:

a body (14) provided with a base that can be applied to the mouth of a liquid container and a delivery nozzle (15) wherefrom the liquid is sprayed, in said body (14) being formed a plunger chamber (20), an input duct (37) which puts the inside of the container into communication with said chamber (20) and an output duct (38) which puts said chamber (20) into communication with the sprayer nozzle (15), through an input hole (34) and an output hole (35) respectively, formed in the rear wall of said chamber (20), a trigger lever (29) hinged to said sprayer body (14) and to the stem (32) of a plunger (33) tightly acting in said chamber (20) defined in the sprayer body (14), spring means (60) interposed between said trigger (29) and said sprayer body (14), and a single suction and delivery valve (100) disposed inside said chamber (20) of the sprayer body to generate a first one-way passage between said input duct (37) of the sprayer body and said chamber (20) and a second one-way passage between said chamber (20) and said output duct (38) of the sprayer body, characterised in that a housing seat (36) suited to integrally engage a central portion (102) of the single valve (100) is disposed in said wall of the chamber (20), in a central position between said input hole (34) and said output hole (35).

2. A sprayer device according to claim 1, characterised in that said suction and delivery valve (100) with respect to said central portion (102) engageable integrally in said valve-housing seat (36) formed in the body (14), comprises:

an upper portion (110) acting as a shutter for said output hole (35), and a lower portion (120) acting as a shutter for said input hole (34).

3. A sprayer device according to claim 2, characterised in that said upper portion of the valve (110) comprises a frustoconical tang (112) with a blind hole (113) tapered so as to generate a side wall thin enough to be deformed radially inward by the liquid pressure, said frustoconical tang (112) engaging in said output hole (35) formed in the sprayer body.

4. A sprayer device according to claim 2, characterised in that said lower portion (110) comprises a substantially dome-shaped portion (122) connected to the valve body (101) by means of two flexible bridges (101'), said dome-shaped portion (122) engaging in said input hole (34) formed in the sprayer body.

5. A sprayer device according to claim 1, characterised in that said spring means comprise a leaf spring (60) consisting of two elastic arms (61), disposed parallel to each other, in which each arm (61) is substantially C-shaped in a side view.

6. A sprayer device according to claim 5, characterised in that said elastic arms (61) are connected to each other, at one of their ends, by a cross connecting bar (62), so that the free ends (63) of the arms (61) are constrained to the trigger (29) and the cross connecting bar (62) abuts against the body (14) of the sprayer.

7. A sprayer device according to claim 6, characterised in that the free ends (63) of said elastic arms (61) of the spring are constrained to the trigger (29) at the point of constraint (31) in which the stem (32) of the piston is hinged and said cross connecting bar (62) of the spring abuts against the body (14) of the sprayer forwardly beneath the piston chamber.

8. A sprayer device according to claim 5, characterised in that said leaf spring (60) is made in a single piece from acetal resin.

* * * * *